US006692227B2

(12) United States Patent
Tomita et al.

(10) Patent No.: US 6,692,227 B2
(45) Date of Patent: Feb. 17, 2004

(54) STATIONARY BLADE SHROUD OF A GAS TURBINE

(75) Inventors: Yasuoki Tomita, Hyogo (JP); Masamitsu Kuwabara, Hyogo (JP); Shunsuke Torii, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 9 days.

(21) Appl. No.: 10/025,533

(22) Filed: Dec. 26, 2001

(65) Prior Publication Data

US 2002/0106276 A1 Aug. 8, 2002

(30) Foreign Application Priority Data

Feb. 6, 2001 (JP) ..... 2001-029848

(51) Int. Cl.[7] ..... F01D 11/12
(52) U.S. Cl. ..... 415/173.7
(58) Field of Search ..... 415/115, 116, 415/138, 139, 174.4, 174.5, 173.7, 180

(56) References Cited

U.S. PATENT DOCUMENTS 4,623,298 A 11/1986 Hallinger et al. ..... 415/139
5,217,348 A 6/1993 Rup, Jr. et al. ..... 415/115
5,352,087 A * 10/1994 Antonellis ..... 415/115
5,429,478 A 7/1995 Krizan et al. ..... 415/173.7

FOREIGN PATENT DOCUMENTS

| | | |
|---|---|---|
| DE | 0 926 314 | 6/1999 |
| JP | 7-13479 | 2/1995 |
| JP | 11-336506 | 12/1999 |

* cited by examiner

*Primary Examiner*—Edward K. Look
*Assistant Examiner*—Dwayne J. White
(74) *Attorney, Agent, or Firm*—Oblon, Spivak, McClelland, Maier & Neustadt, P.C.

(57) ABSTRACT

A base plate and honeycomb member disposed at the inner circumference side of an inside shroud are fixed to the inside shroud, at a phase deviation in the peripheral direction, with respect to the inside shroud, so as to plug the missing range of seal member, out of gaps between adjacent inside shrouds, and therefore leakage of purge air from the missing range of seal member is prevented without adding new constituent members.

7 Claims, 8 Drawing Sheets

SECTION ALONG LINE I-I

SECTION ALONG LINE II-II

STATIONARY BLADE SHROUD OF A GAS TURBINE

FIELD OF THE INVENTION

The present invention relates to a stationary blade shroud of a gas turbine. More particularly, this invention relates to a stationary blade shroud improved in the sealing performance in the gaps between adjacent stationary blade inside shrouds.

BACKGROUND OF THE INVENTION

The turbine section of a gas turbine used in a generator or the like comprises moving blades which rotate together with the rotor, and stationary blades which are fixed in the casing. The moving blade is composed of a platform coupled to the rotor and a moving blade. The stationary blade is composed of a stationary blade and inside shroud and outside shroud fixed at both ends of this stationary blade.

The blade surface, and inside and outside shrouds of the stationary blade form a passage wall of high temperature gas flowing in the turbine section, and the blade surface and platform of the moving blade also form a passage wall of high temperature gas. In the casing, split rings for forming the passage wall of high temperature gas together with the blade surface and platform of the moving blade are fixed across a specific gap to the leading end of the moving blade. A plurality of split rings are coupled in the arraying direction of the moving blades, and a wall of an annular section is formed on the whole.

On the other hand, the moving blades and stationary blades are divided into a plurality of sections in the peripheral direction of the rotor and formed in units for the convenience of performance for absorbing thermal deformation, manufacture or maintenance, and the shrouds and platforms, like the split rings, are coupled in a plurality in the blade arraying direction, forming a wall of an annular section on the whole, and each is formed in an arc section.

When coupling the divided inside shrouds in the peripheral direction of the rotor, a gap must be held preliminarily between the coupled inside shrouds. This is because the shrouds are thermally expanded in the peripheral direction as being exposed to high temperature gas sent from the combustor of the gas turbine, and it is preferred to design so that this gap is completely eliminated in the thermally expanded state.

That is, when the high temperature gas flows in the passage formed by the blade surface, shroud, platform or split ring, the high temperature gas escapes outside through the gap formed between the coupled shrouds, and the turbine efficiency declines, or contamination may deposit in other area than the passage due to combustion gas which is high temperature gas, possibly leading to unexpected accident.

Actually, however, considering the manufacturing error and others, it is impossible to eliminate such gaps completely in high temperature condition. Accordingly, hitherto, it has been attempted to prevent escape of high temperature gas V1 from the gap 43*g* to outside by installing a seal member 44 between the coupled inside shrouds 43 as shown, for example, in the inside shroud 43 in FIG. 6.

More specifically, as shown in FIG. 7A that shows a section along line I—I in FIG. 6 and FIG. 7B that shows a section along line II—II, the seal member 44 is disposed in the groove extending in the downstream direction from the vicinity of the upstream side end 43*b* of flow direction of high temperature gas V1 formed in the side end 43*a* of the inside shroud 43.

Near the upstream side end 43*b* of the inside shroud 43, and along the inner circumference of the inside shroud 43, honeycomb members 43*d* of arc shape (shown in linear shape in FIG. 6 for the sake of simplicity) are disposed, and are provided on the inner circumference of the inside shroud 43 through a base plate 43*c,* and are disposed across a slight gap to seal fins 47*a* formed on the platform 47 of the moving blade 46 rotating as shown in FIG. 8.

The honeycomb members 43*d* are provided to prevent heavy contact between the rotary parts (including the platform 47) of the moving blade 46 and the stationary part including the stationary blade 42 due to rotary shaft runout of the rotating moving blades 46, and as far as the shaft runout is small, that is, in a stage of light contact before coming into heavy contact, the seal fin 47*a* and honeycomb member 43*d* contact with each other, and the honeycomb member 43*d* is broken. On the other hand, the seal fin 47*a* is higher in hardness than the honeycomb member 43*d,* and is not broken, and only by replacing the honeycomb member 43*d,* the original state is restored, and therefore the honeycomb member 43*d* may be called light contact detecting step for preventing heavy contact with the rotary part of the moving blade 46.

In the example shown in FIG. 6 and FIG. 7, the seal member 44 is disposed nearly along the overall length in the flow direction of high temperature gas V1 at the side end 43*a* of the inside shroud 43, and leak of high temperature gas V1 is nearly prevented, but in other structure of inside shroud 43, the seal member 44 cannot be disposed in the overall length of the side end 43*a*.

That is, in such structure, the seal member 44 cannot be disposed because the thickness is insufficient near the upstream side end 43*b* of the inside shroud 43. Such structure is explained in FIG. 8 and FIG. 9.

FIG. 8 shows a stage composed of the moving blade 46 and the stationary blade 42 in the turbine section. Purge air V3 is first supplied into an outside shroud 45 to cool the outside shroud 45 as cooling air for cooling the outside shroud 45, and part of the cooling air passes through the cooling air passage formed in the stationary blade 42 to cool the stationary blade 42, and is supplied into the inside shroud 43 as cooling air, and is partly used as purge air V3.

Further, part of the purge air V3 is blown out from the gap between the moving blade 46 of the front stage and the platform 47 as shown in FIG. 8 as seal air V4, thereby preventing high temperature gas V1 from escaping from the gap between the platform 47 and inside shroud 43, but it is not desired if the blown-out seal air V4 disturbs the flow of the high temperature gas V1 too much, and it is desired to guide the seal air V4 smoothly into the flow direction of high temperature gas V1.

In order to guide the flow of the seal air V4 smoothly, as shown in FIG. 9A, the upper end corner of the inside shroud 43 is rounded, so that the seal air V4 may flow along the upper side 43*b* (passage side of the high temperature gas V1) of the inside shroud 43.

The cooling air passage 43*e* for passing the cooling air may be formed inside of the inside shroud 43. This cooling air passage 43*e* is formed at a deep position near the top of the inside shroud 43 so as to cool the inside shroud 43 itself and also cool the junction between the stationary blade 42 and the inside shroud 43, but when this cooling air passage 43*e* is formed up to the upstream side end 43*b,* as shown in FIG. 9A, it interferes with the cooling air passage 43*e,* and hence the seal member 44 cannot be disposed near the upstream side end 43*b*.

As a result, as shown in FIG. 9B, near the upstream side end 43*b*, there is a missing range of seal member 44, and the purge air V3 may massively escape from the mixing range, and the gas turbine efficiency may be lowered.

Thus, in addition to the case of forming the upstream side end 43*b* of the inside shroud 43 by rounding, missing range of seal member 44 may occur due to various causes in design and structure, and anyway if missing range of seal member 44 occurs, regardless of the cause, the efficiency of the gas turbine may be lowered due to massive leak of purge air V3.

SUMMARY OF THE INVENTION

It is an object of this invention to present a stationary blade shroud capable of suppressing leak of purge air, without increasing the cost, even if a seal missing range occurs in the seal member in the gap of the inside shroud.

The stationary blade shroud according to the present invention comprises circular honeycomb members preventively broken by contact with rotary parts of moving blades disposed along the inner circumference of inside shroud of each stationary blade divided into plural parts in the peripheral direction. The honeycomb members are disposed as being deviated in the peripheral direction with respect to the stationary blade inside shroud so as to plug the gaps formed between adjacent stationary blade inside shrouds.

Herein, by "preventively broken by contact with rotary parts of moving blades" it means that they are broken by a light contact in a stage before causing heavy contact with the rotary parts of the moving blades, so that major damage by heavy contact can be prevented.

The honeycomb members may be disposed so that the honeycomb extending direction may or may not coincide with the purge air flow direction (direction from inner circumference side of inside shroud to outer circumference side, that is, turbine radial direction), but when disposed so that the honeycomb extending direction coincides with the purge air flow direction, the purge air passes through the honeycomb, and it is preferred to install a base plate to plug the opening of the honeycomb. However, since the honeycomb members hitherto used for the purpose of preventing heavy contact are disposed in the inside shroud through such base plate from the beginning, and it is enough to use honeycomb members having such base plate.

According to the stationary blade shroud, since the existing honeycomb members provided to prevent heavy contact also play the role of plugging the gaps formed between the inside shrouds of the stationary blades, leak of purge air can be suppressed. New constituent elements are not additionally needed to plug the gaps, and the increase of cost is prevented.

Other objects and features of this invention will become apparent from the following description with reference to the accompanying drawings.

DETAILED DESCRIPTIONS

An embodiment of a stationary blade shroud of a gas turbine of the invention is described below while referring to the accompanying drawings. It must be noted, however, that the invention is not limited to the illustrated embodiment alone.

Figure 1:
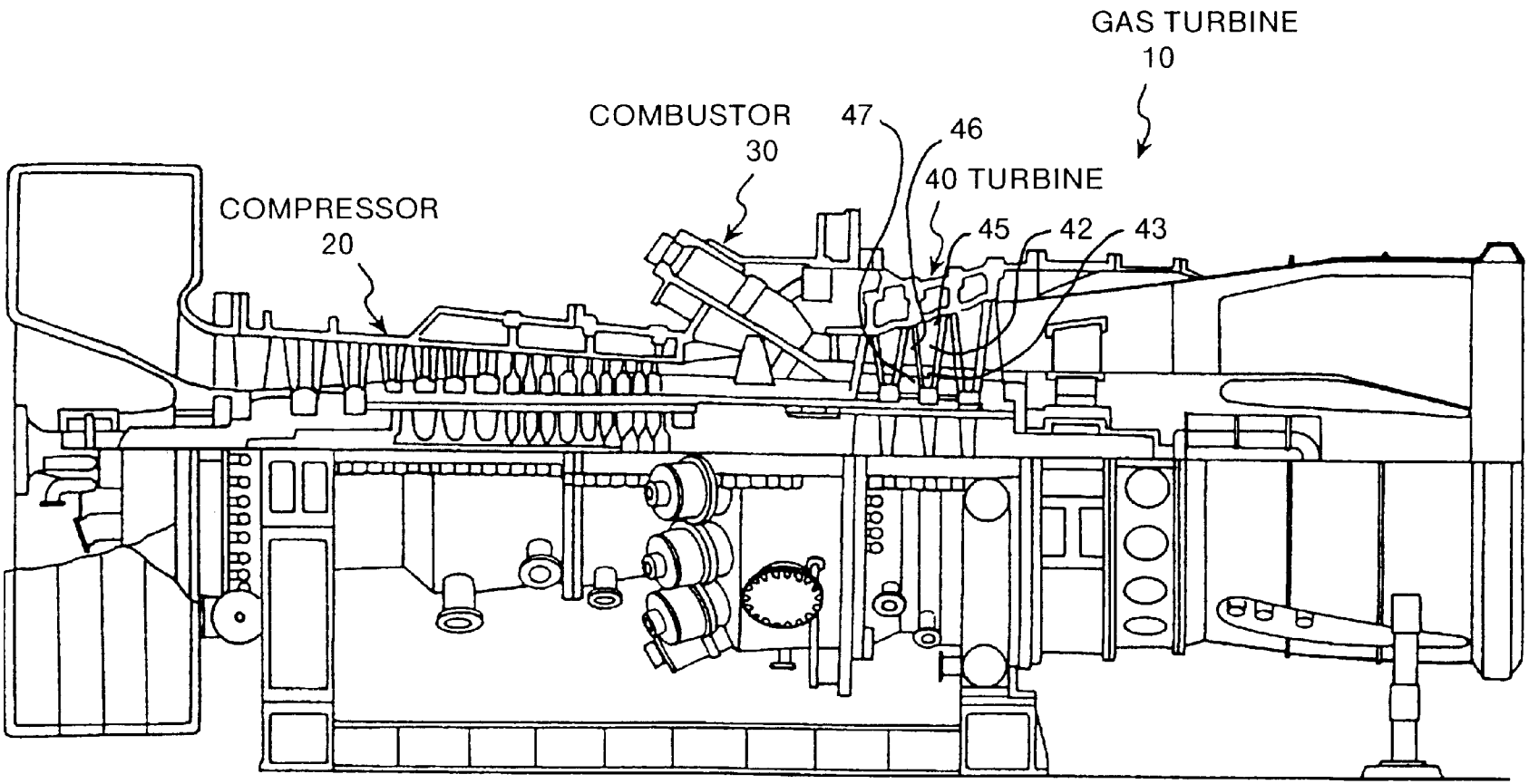
FIG. 1 is a semi-sectional view showing an entire gas turbine using the stationary blade inside shroud in an embodiment of the invention.

FIG. 1 is a partial longitudinal sectional view of an entire gas turbine 10 for explaining the stationary blade shroud of the gas turbine according to an embodiment of the invention, and the gas turbine 10 comprises a compressor 20 for compressing incoming air, a combustor 30 for injecting fuel to the compressed air obtained from the compressor 20 and generating high temperature combustion gas (high temperature gas), and a turbine 40 for generating a rotary driving force by the high temperature gas generated from the combustor 30. The gas turbine 10 also has a cooler, not shown, for extracting part of the compressed air from the compressor 20, and sending out the extracted compressed air to moving blades 46 of the turbine 40, stationary blades 42, moving blade platforms 47, and inside shroud 43 and outside shroud 45 of stationary blades 42.

Figure 2:
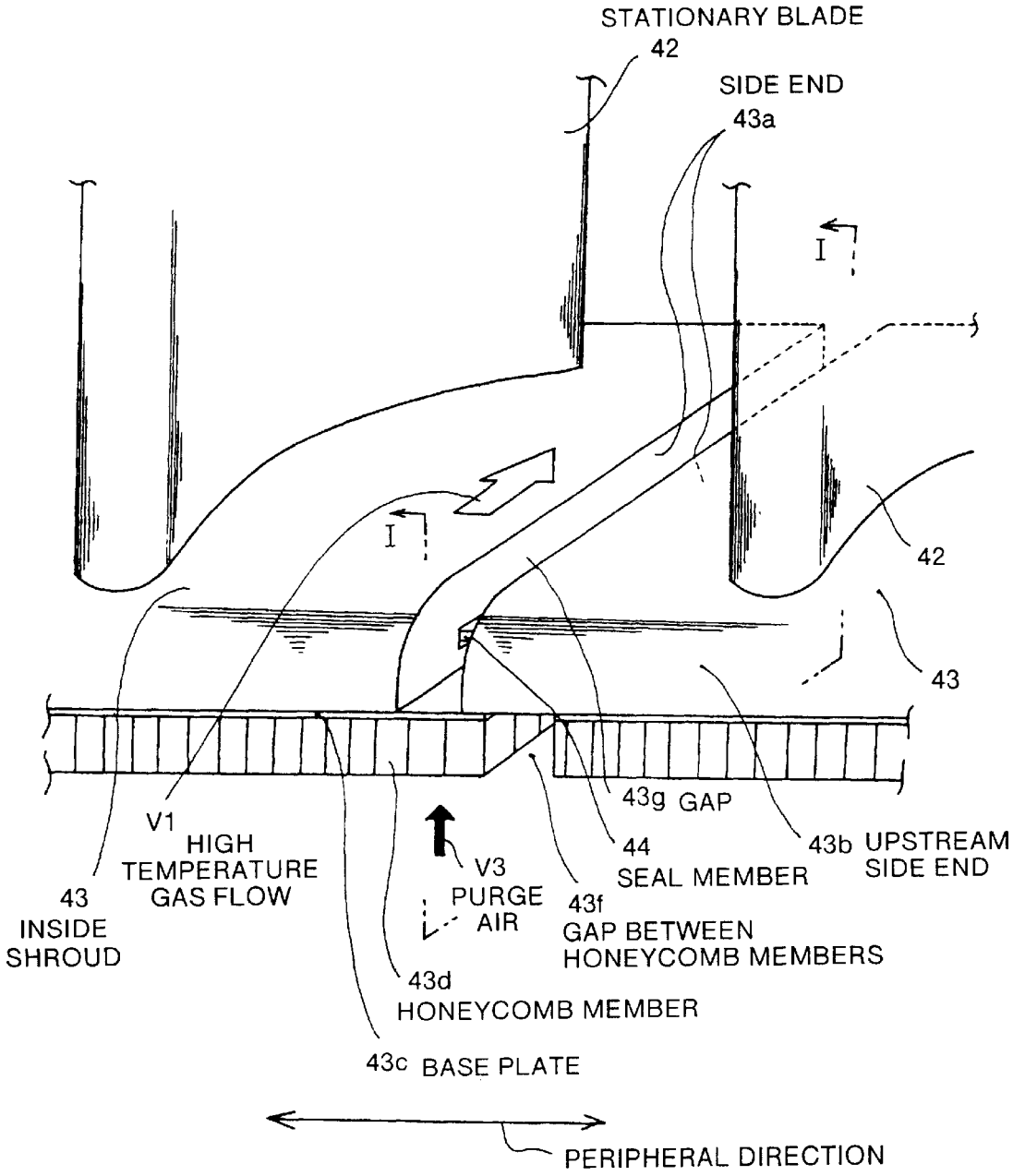
FIG. 2 is a schematic diagram showing the stationary blade inside shroud in the embodiment of the invention.
Figure 3:
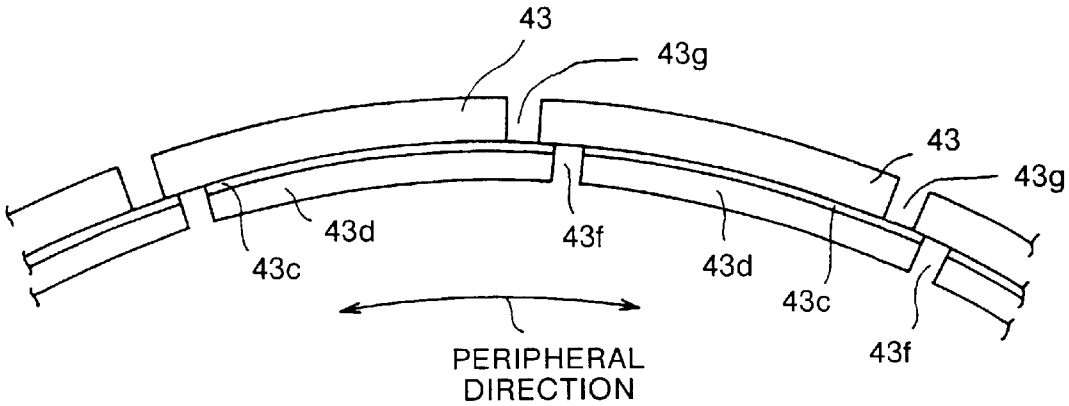
FIG. 3 is a diagram for explaining the configuration of honeycomb members relating to the peripheral direction of the stationary blade inside shroud shown in FIG. 2.

The inside shroud 43 of the stationary blade 42 is, as shown in FIG. 2, affixed to the inner circumferential end of the stationary blade 42, and a plurality of the inside shrouds 43 are coupled and disposed around the shaft of the turbine. In FIG. 2, the arrow in the peripheral direction and the line in the drawing parallel to this arrow are shown as straight lines, but actually, as shown in FIG. 3, they are arcs having the center in the center of the rotary shaft of the turbine 40.

Figure 8:
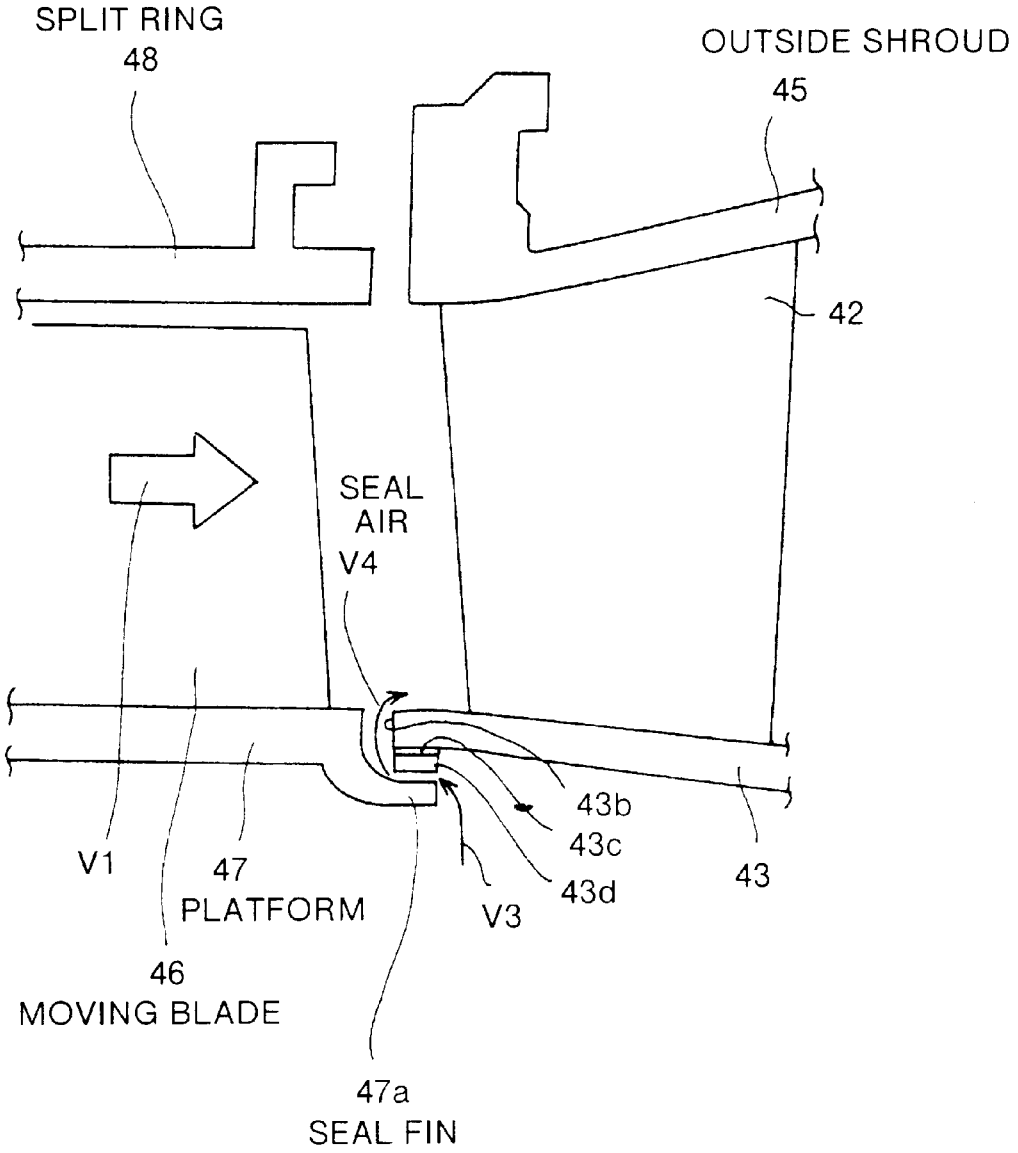
FIG. 8 is an explanatory diagram of seal air and honeycomb member.
Figure 9A:
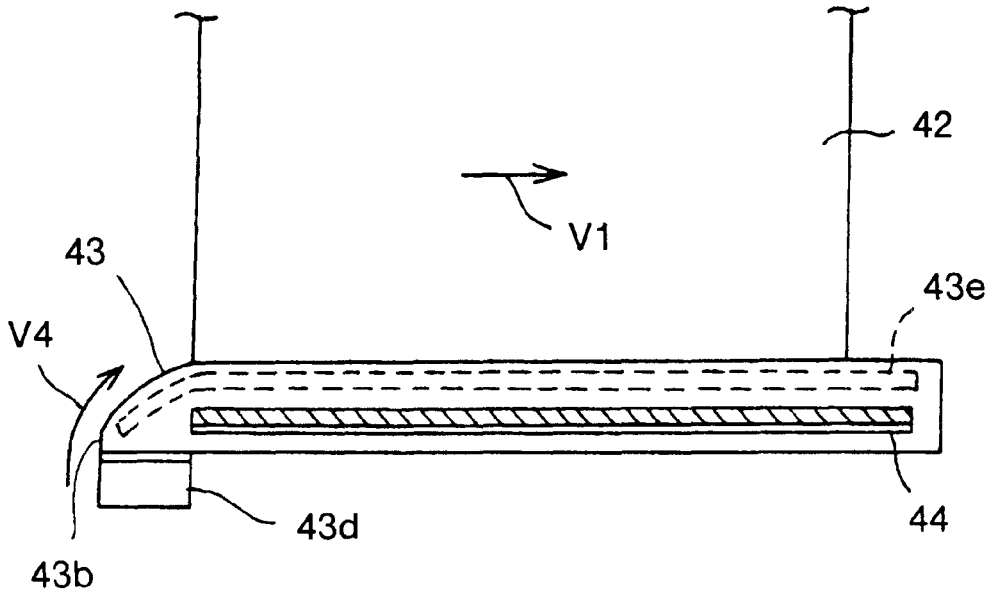
FIG. 9A is for explaining why the seal member is missing.
Figure 9B:
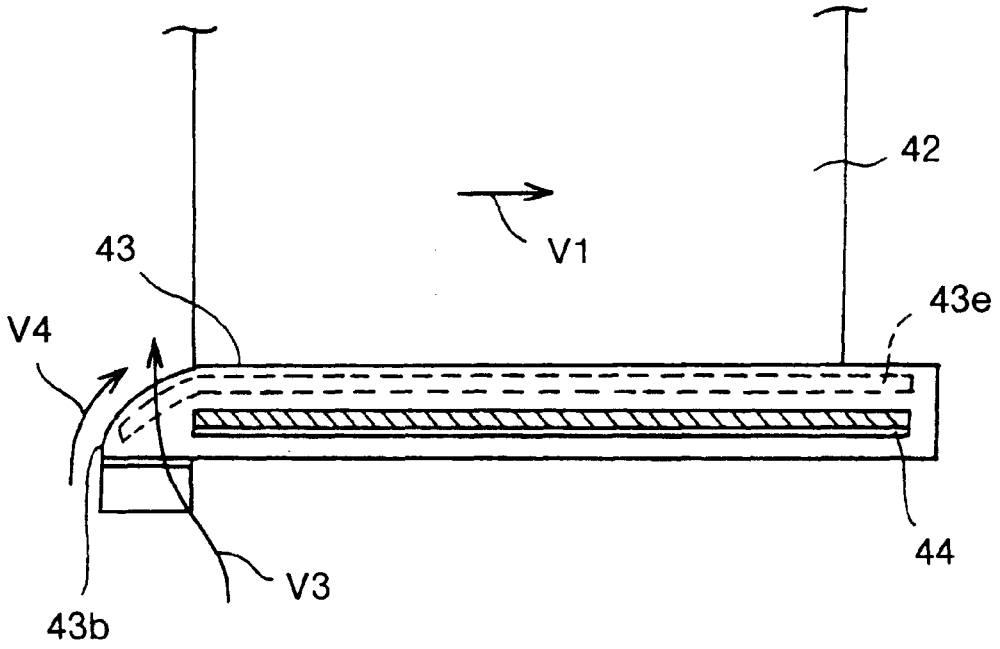
FIG. 9B is for explaining a leak of a purge air.

On the inner circumference of each inside shroud 43 and near the upstream side end 43*b* at the end of the upstream side of high temperature gas V1, honeycomb members 43*d* of honeycomb structure are disposed by way of a base plate 43*c*, and they are intended to prevent heavy contact by disposing, as shown in FIG. 8, so as to be broken by contact with a seal fin 47*a* of the platform 47 by light contact in a stage before heavy contact between the stationary inside shroud 43 and platform 47 of the rotating moving blade 46.

Between side ends 43*a* of adjacent inside shrouds 43, generally, a specified gap 43*g* is formed to absorb thermal expansion in the peripheral direction of the inside shroud 43, and between the both side ends 43*a*, a seal member 44 is crossed over to prevent leak of high temperature gas flowing on the upper side in the drawing of the inside shroud 43 to outside, that is, the lower side in the drawing.

However, the seal member 44 is not extended to the vicinity of the upstream side end 43*b* of the inside shroud 43. That is, as shown in FIG. 8, in order that seal air V4 (see FIG. 8) blown out from the gap between the upstream side end 43*b* of inside shroud 43 and the platform 47 of the moving blade 46 disposed in a previous stage of the stationary blade 42 may flow smoothly on the upper side in the drawing of the inside shroud 43, the corner of the upstream side end 43*b* is rounded, and enough thickness for disposing the seal member 44 is not available.

Figure 4:
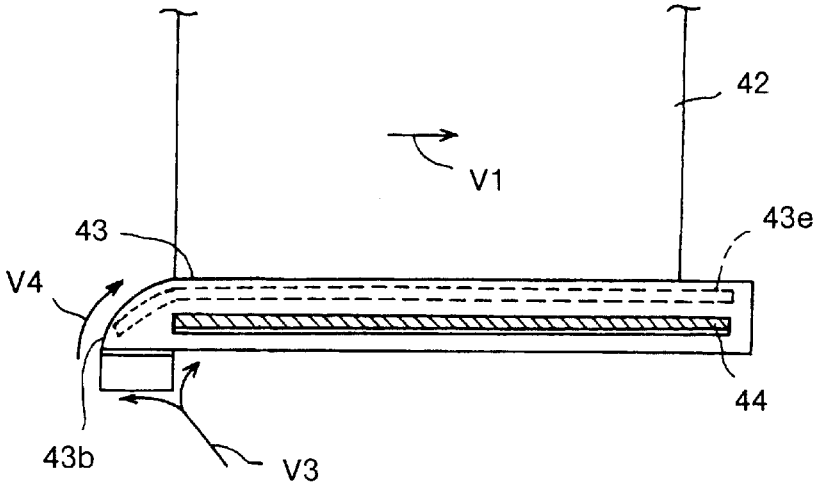
FIG. 4 is a sectional view along line I—I in FIG. 2.

More specifically, as shown in FIG. 4 which is a sectional view along line I—I in FIG. 2, at the outside of the seal member 44 (upper side in the drawing), a cooling air passage 43*e* is formed for passing the cooling air for cooling the inside shroud 43 itself and the inner circumferential end of the stationary blade 42, and this cooling air passage 43*e* extended nearly to the upstream side end 43*b* of thick plate thickness, which is why the seal member 44 cannot be extended nearly to the upstream side end 43*b*.

Thus, since the seal member 44 is not extended up to the upstream side end 43*b*, the vicinity of the upstream side end 43*b* of the gap 43*g* is a missing range of seal member 44, and in a conventional stationary blade shroud, the purge air V3 may escape from the missing range of the seal member 44 and blow out into the passage of high temperature gas V1, possibly impeding smooth flow of high temperature gas V1.

On the other hand, in the inside shroud 43 of the embodiment, as shown in FIG. 2 and FIG. 3, the base plate 43*c* and honeycomb member 43*d* disposed at the inner circumference side of each inside shroud 43 are fixed to the inside shroud 43, with the phase shifted in the peripheral direction with respect to the inside shroud 43, so as to plug the missing range of the seal member 44 of the gap 43*g*.

Figure 6:
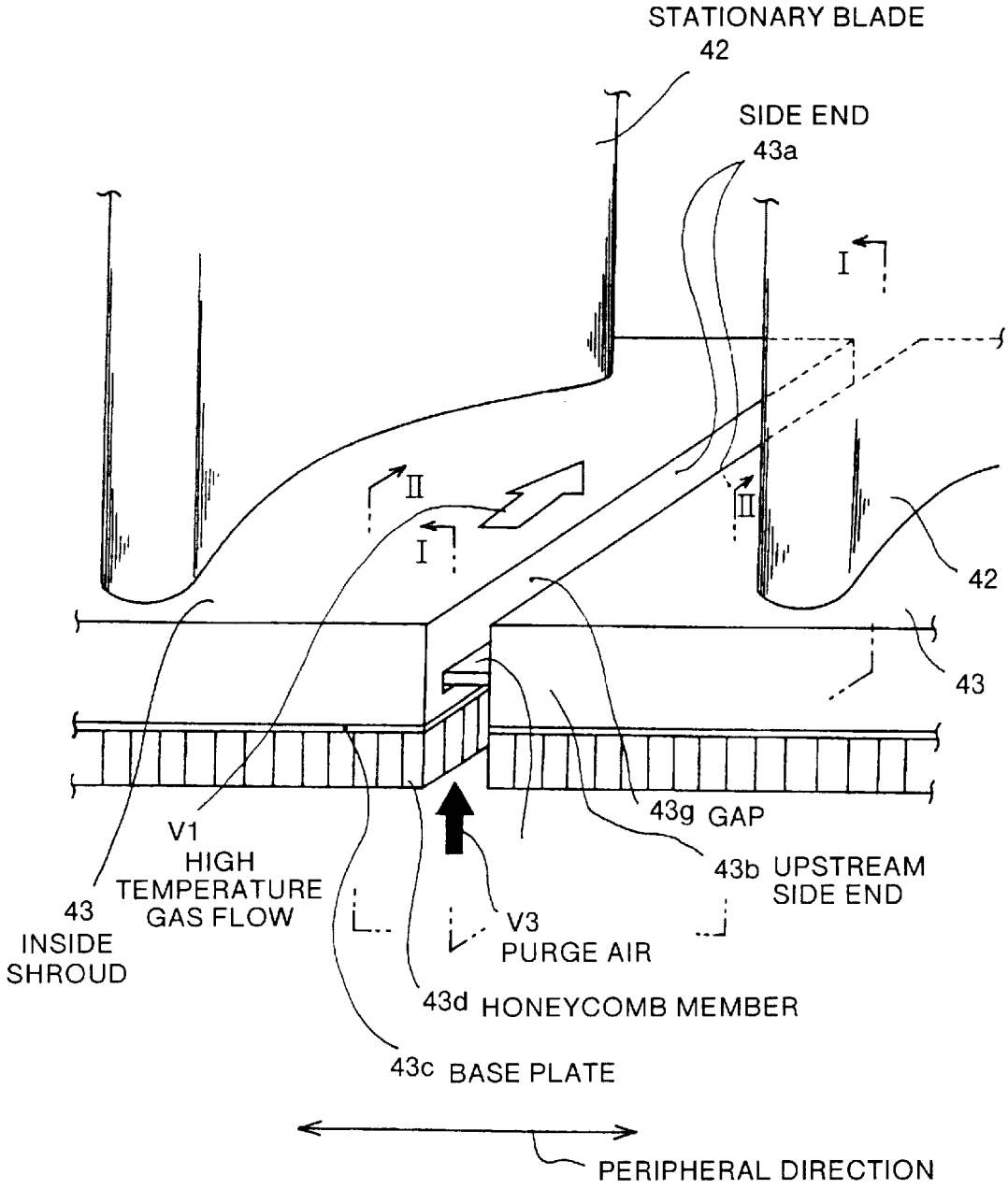
FIG. 6 is a schematic diagram of a conventional stationary blade inside shroud.
Figure 7A:
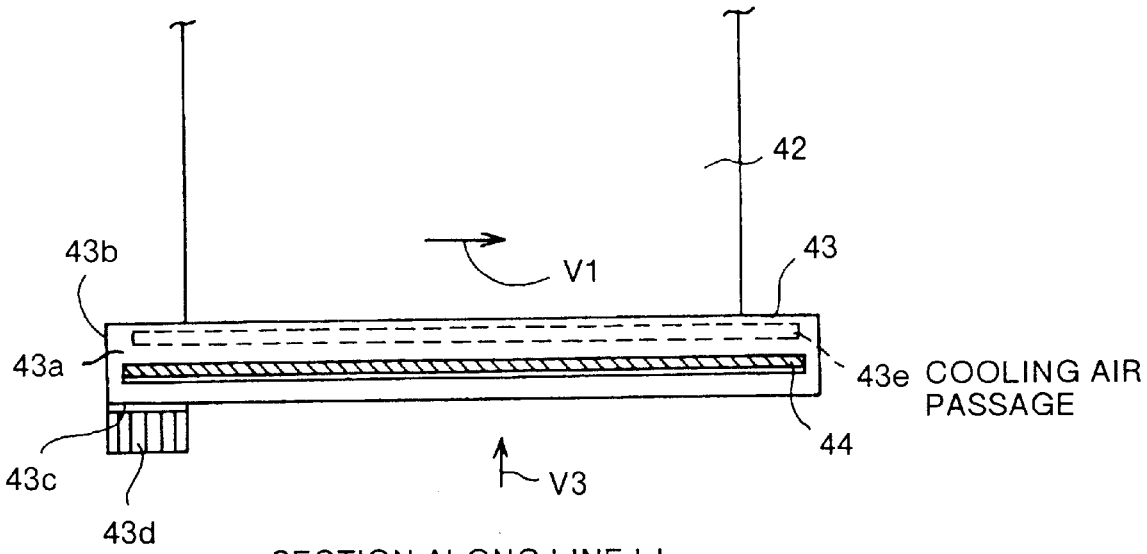
FIG. 7A is a sectional view along line I—I in FIG. 6
Figure 7B:
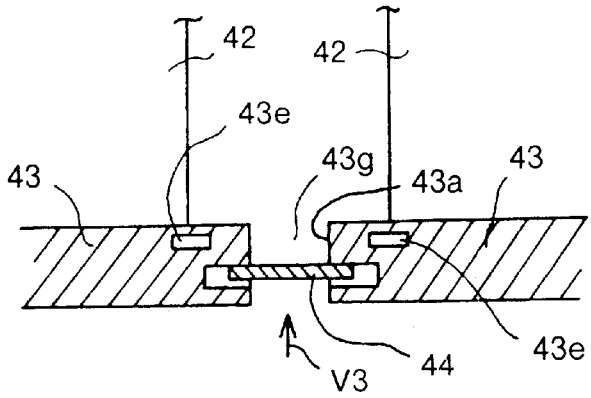
FIG. 7B is a sectional view along line II—II in FIG. 6.

In the conventional inside shroud, as shown in FIG. 6, the base plate 43*c* and honeycomb member 43*d* do not project from the side end 43*a* of the inside shroud 43, and the base plate 43*c* and honeycomb member 43*d* are fixed so that the inside shroud 43, base plate 43*c* and honeycomb member 43*d* may be at the same phase position with respect to the axial center of the turbine 40. Accordingly, the gap 43*g* between the inside shrouds 43 and the gap 43*f* between honeycomb members 43*d* are present at the same phase position.

However, as shown in FIG. 2 and FIG. 3, in the inside shroud 43 of the embodiment, the base plate 43*c* and honeycomb member 43*d* project from the side end 43*a* of the inside shroud 43, and the base plate 43*c* and honeycomb member 43*d* are fixed so that the gaps 43*g* between the inside shrouds 43 and the gap 43*f* between honeycomb members 43*d* are present at different phase positions. This phase deviation is a sufficient amount for plugging the gaps 43*g* between the adjacent inside shrouds 43 by the base plate 43*c* and honeycomb member 43*d* projecting from the side end 43*a* of the inside shroud 43.

Therefore, as shown in FIG. 4, the vicinal range of the upstream side end 43*b* where the seal member 44 is missing is plugged by the base plate 43*c* and honeycomb member 43*d*, so that escape of purge air V3 from this range to blow out into the passage of high temperature gas V1 is avoided.

Thus, according to the inside shroud 43 of the embodiment, the base plate 43*c* and honeycomb member 43*d* already provided for preventing heavy contact also work to plug the gaps 43*g* formed between the inside shrouds 43, and leak of purge air V3 can be suppressed, and to plug the gaps 43*g*, no additional constituent elements are needed, and increase of cost is prevented.

Figure 5:
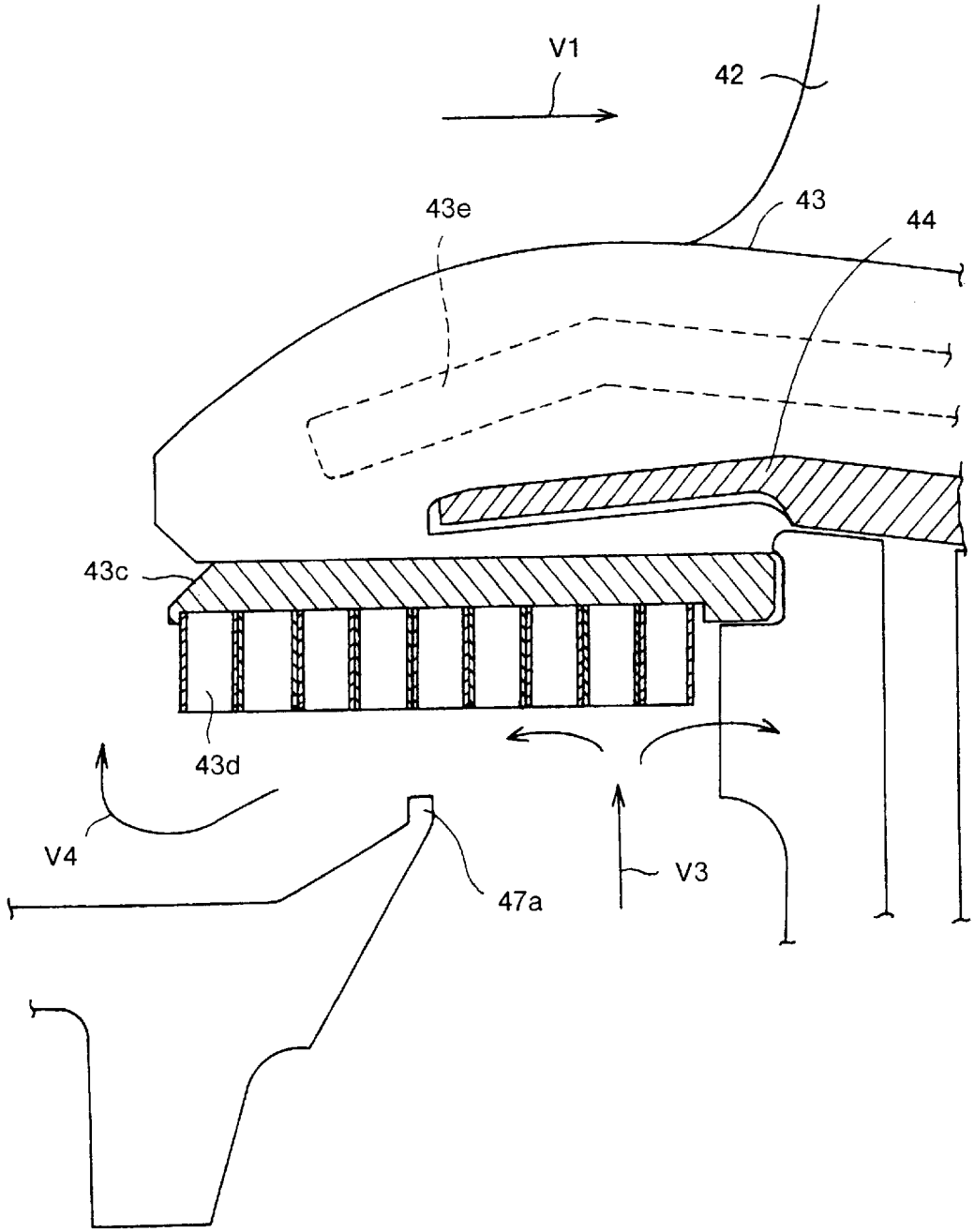
FIG. 5 is a detailed drawing of upstream side end of stationary blade inside shroud shown in FIG. 4.

The detail of the vicinity of the upstream side end 43*b* of the inside shroud 43 shown in FIG. 4 is given in FIG. 5. In the inside shroud 43 of the embodiment, the base plate 43*c* and honeycomb member 43*d* are disposed only near the upstream side end 43*b*, but the stationary blade shroud of the invention is not limited to this embodiment alone, and in the inside shroud 43 having the base plate 43*c* and honeycomb member 43*d* similarly also near the downstream side end of the high temperature gas V1, the base plate 43*c* and honeycomb member 43*d* near the downstream side end may be deviated in the peripheral direction with respect to the inside shroud 43 so as to plug the gaps 43*g* formed between the adjacent inside shrouds 43.

As described herein, according to the stationary blade shroud of a gas turbine of the invention, since the existing honeycomb members provided to prevent heavy contact also play the role of plugging the gaps formed between the inside shrouds of the stationary blades, leak of purge air can be suppressed. New constituent elements are not additionally needed to plug the gaps, and the increase of cost is prevented.

According to the stationary blade shroud of a gas turbine of the invention, of the gaps between stationary blade shrouds, the seal members plug the bridges range of the seal members, and the honeycomb members plug the missing range of seal member, and new constituent elements are not additionally needed, and leak of purge air can be suppressed.

According to the stationary blade shroud of a gas turbine of the invention, gaps in the vicinal portion of the gas flow upstream side end between stationary blade inside shrouds where the seal member is likely to be missing can be plugged by the honeycomb members disposed in this vicinal portion, so that leak of purge air can be suppressed without adding new constituent elements.

The vicinal portion of the gas flow upstream side end of the stationary blade inside shroud is often formed by rounding in order to make smooth the flow of seal air blown out from the gap of the platform of the moving blade of the preceding stage, and hence it is hard to dispose seal members, and leak of purge air is likely to occur, but according to the stationary blade shroud of a gas turbine of the invention, at least gaps in such range can be plugged by the honeycomb members, so that leak of purge air can be suppressed without adding new constituent elements.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A stationary blade shroud of a gas turbine comprising:

circular honeycomb members adapted to be preventively broken by contact with rotary parts of moving blades, the honeycomb members disposed along the inner circumference of an inside shroud of each stationary blade divided into plural parts in a peripheral direction, wherein the honeycomb members are disposed as being deviated in the peripheral direction with respect to the stationary blade inside shroud so as to plug gaps formed between adjacent stationary blade inside shrouds, and the honeycomb members are disposed so as to plug at least a missing range of a seal member bridged over between adjacent stationary blade inside shrouds.

2. The stationary blade shroud according to claim 1, wherein the honeycomb members are disposed at least near a gas flow upstream side end of the stationary blade inside shroud.

3. A stationary blade shroud of a gas turbine comprising:

circular honeycomb members adapted to be preventively broken by contact with rotary parts of moving blades, the honeycomb members disposed along the inner circumference of inside shroud of each stationary blade divided into plural parts in a peripheral direction, wherein the honeycomb members are disposed as being deviated in the peripheral direction with respect to the stationary blade inside shroud so as to plug gaps formed between adjacent stationary blade inside shrouds, and a vicinal portion of a gas flow upstream side end of the stationary blade inside shroud is formed by rounding.

4. A stationary blade shroud of a gas turbine, including an inside shroud divided into a plurality of parts in the peripheral direction, the stationary blade shroud comprising:

seal members disposed between the divided parts of the inside shroud so as to prevent leakage of high temperature gas through gaps formed between the divided parts; and honeycomb members disposed along the inner circumference of the inside shroud, wherein the honeycomb members are configured to prevent leakage of gas in radial direction of the gas turbine, and are disposed such that a phase of gaps between the honeycomb members, in the peripheral direction with respect to the inside shroud, is deviated from a phase of the gaps between the divided parts so as to prevent the leakage through the gaps between the divided parts.

5. The stationary blade shroud according to claim 4, wherein the gaps between the divided parts include a missing range of the seal members, and the honeycomb members are disposed so as to prevent the leakage of gas through the missing range.

6. The stationary blade shroud according to claim 4, wherein the honeycomb members are disposed at least near a gas flow upstream side end of the inside shroud.

7. The stationary blade shroud according to claim 6, wherein the inside shroud has a rounded shape in the vicinity of the gas flow upstream side end thereof.

* * * * *